US008150305B2

(12) United States Patent
Shin

(10) Patent No.: US 8,150,305 B2
(45) Date of Patent: Apr. 3, 2012

(54) FUSING DEVICE AND IMAGE FORMING APPARATUS HAVING THE SAME

(75) Inventor: Su Ho Shin, Seongnam-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 420 days.

(21) Appl. No.: 12/541,634

(22) Filed: Aug. 14, 2009

(65) Prior Publication Data

US 2010/0158587 A1 Jun. 24, 2010

(30) Foreign Application Priority Data

Dec. 24, 2008 (KR) ..... 10-2008-0133485

(51) Int. Cl.
*G03G 15/20* (2006.01)

(52) U.S. Cl. ..... 399/329

(58) Field of Classification Search ..... 399/328, 399/329, 330, 334; 219/216, 469–471
See application file for complete search history.

(56) References Cited

U.S. PATENT DOCUMENTS 7,890,040 B2 * 2/2011 Lee et al. ..... 399/329
2003/0095818 A1 * 5/2003 Nakayama ..... 399/328
2008/0240806 A1 * 10/2008 Lee et al. ..... 399/328
2009/0016789 A1 * 1/2009 Kim et al. ..... 399/329
2009/0092423 A1 * 4/2009 Shin et al. ..... 399/329

FOREIGN PATENT DOCUMENTS

JP 2004-258484 9/2004

OTHER PUBLICATIONS

English language abstract of JP 2004-258484, published Sep. 16, 2004.
Machine English language translation of JP 2004-258484, published Sep. 16, 2004.

* cited by examiner

*Primary Examiner* — Susan Lee
(74) *Attorney, Agent, or Firm* — Stanzione & Kim, LLP

(57) ABSTRACT

Disclosed are a fusing device with improved temperature increase and fusing performance characteristics and an image forming apparatus having the same. The fusing device can include a heater to generate heat, a fusing belt arranged around the heater, a rotating member, a press member and a heat shield unit. The rotating member may be configured to come into contact with an outer periphery of the fusing belt. The press member may be configured to be press a portion of the fusing belt toward the rotating member to define a fusing nip between the fusing belt and the rotating member. The heat shield unit configured to surround the press member to reduce the amount of heat delivered to the press member.

25 Claims, 7 Drawing Sheets

FUSING DEVICE AND IMAGE FORMING APPARATUS HAVING THE SAME

CROSS-REFERENCE TO RELATED APPLICATION

This application claims the benefit of Korean Patent Application No. 2008-0133485, filed on Dec. 24, 2008 in the Korean Intellectual Property Office, the disclosure of which is incorporated herein by reference in its entirety.

TECHNICAL FIELD

The present disclosure relates to a fusing device having improved temperature increase performance and fusing performance, and an image forming apparatus having the same.

BACKGROUND OF RELATED ART

Image forming apparatuses are used to form an image on a printing medium. Examples of image forming apparatuses include printers, copiers, facsimiles, and devices that combine at least some of the functionality from such apparatuses.

In an electro-photographic image forming apparatus, after light is irradiated to a photoconductor charged with a predetermined electric potential to form an electrostatic latent image on a surface of the photoconductor, a developer can be fed to the electrostatic latent image to form a visible image. The visible image formed on the photoconductor can be transferred to a printing medium directly or can be transferred to the printing medium indirectly via an intermediate transfer medium. After being transferred to the printing medium, the visible image can be fixed to the printing medium while passing through a fusing device.

A common fusing device generally includes a heating roller containing a heater therein, and a press roller configured to come into close contact with the heating roller to thereby define a fusing nip between the rollers. When a printing medium, to which a toner image is transferred, enters between the heating roller and the press roller, the toner image can be fixed to the printing medium by the heat that is radiated from within the heating roller and by the pressure that acts on the fusing nip.

In the above-described fusing device, the heating roller can have a large thermal capacity and heating (e.g., warming up) the heating roller to a desired fusing temperature in an initial operating stage of the image forming apparatus can require an excessively long time. In response to a demand for high-speed operation of the image forming apparatus, a fusing devices that can rapidly raise a nip temperature would be desirable.

SUMMARY OF THE DISCLOSURE

In accordance with one or more aspects of the present disclosure, a fusing device may be provided to include a heater, a fusing belt, a rotating member, a press member and a heat shield unit. The heater may be configured to generate heat. The fusing belt may be disposed around the heater. The rotating member may be configured to rotate in contact with an outer periphery of the fusing belt. The press member may be disposed within the fusing belt. The press member may be configured to press a portion of the fusing belt toward the rotating member to define a fusing nip between the fusing belt and the rotating member. The heat shield unit may be configured to surround the press member to reduce an amount of heat received by the press member from the heater.

The heat shield unit may include a heat conducting portion configured to come into contact with an inner periphery of the fusing belt to thereby conduct heat to the fusing nip.

The heat shield unit may have a heat conductivity higher than that of the press member.

The fusing device may further comprise a spacer disposed between the heat conducting portion of the heat shield unit and the press member.

The spacer may have a heat conductivity lower than that of the heat shield unit.

The heat shield unit may have an inverted arch shape.

The heat shield unit may include a layer that may be configured to reflect heat generated by the heater. The layer may be disposed in a portion of the heat shield unit facing the heater.

A portion of the heat shield unit may define an indentation directed toward the press member.

An opening may be defined at each end of the heat shield unit. The press member may be configured to have opposite ends that protrude out of the openings at the ends of the heat shield unit.

The heat shield unit may be longer than the fusing belt.

The heat shield unit may be formed as a single unitary member.

The heat shield unit may include a first heat shield member and a second heat shield member. At least a portion of the first heat shield member may be configured to face the heater. At least a portion of the second heat shield member may be configured to face the inner periphery of the fusing belt.

The first heat shield member may be made of a first material. The second heat shield member may be made of a second material different from the first material.

The heat shield unit may include an overlap portion where the first heat shield member and the second heat shield member overlap each other.

The fusing device may further comprise a guide member disposed between the heat shield unit and the fusing belt. The guide member may be configured to support the heat shield unit and to guide the fusing belt near the fusing nip.

According to another aspect, an image forming apparatus may be provided to include a printing device and a fusing device. The printing device may be configured to form an image on a printing medium. The fusing device may be configured to fix the image to the printing medium, and may include a heater, a fusing belt, a rotating member, a press member and a heat shield unit. The heater may be configured to generate heat. The fusing belt may be disposed around the heater. The rotating member may be configured to rotate in contact with an outer periphery of the fusing belt. The press member may be configured to press a portion of the fusing belt toward the rotating member to define a fusing nip between the fusing belt and the rotating member. The heat shield unit may include a first portion and a second portion. The first portion of the heat shield unit may be located between the heater and the press member, and may be configured to absorb heat radiating from the heater. The second portion may be configured to come into contact with an inner periphery of the fusing belt to thereby conduct heat to the fusing nip.

The press member may be disposed inside the heat shield unit.

The heat shield unit may have a heat conductivity higher than a heat conductivity of the press member.

The fusing device may further include a spacer disposed between the second portion of the heat shield unit and the press member.

The heat shield unit may include a layer disposed over the first portion of the heat shield unit. The layer may be configured to reflect heat from the heater.

The heat shield unit may define an indentation in the first portion of the heat shield unit.

The heat shield unit may include a plurality of members. A first one of the plurality of members may be made of a first material different from a second material of which a second one of the plurality of members is made.

According to yet another aspect, a fusing device for fixing a toner image on a print medium may be provided to include a belt, a heat source, a first member and a second member. The belt may define a loop. The heat source may be disposed inside the loop, and may be configured to produce heat. The first member may be disposed inside the loop, and may be configured to exert a pressure on a first portion of inner periphery of the belt. The second member may be configured to shield the first member from the heat produced by the heat source. A portion of the second member may be in contact with the first portion of inner periphery of the belt.

The fusing device may further include a third member disposed outside the loop. The third member may be configured to rotate in contact with an outer periphery of the belt to define a fusing nip at a nip portion between the belt and the third member and in proximity to the first portion of inner periphery of the belt.

The second member may define an indentation. The heat source may comprise a plurality of heat sources. At least one of the plurality of heat sources may at least partially occupy a space defined by the indentation in the second member.

BRIEF DESCRIPTION OF THE DRAWINGS

Various aspects and advantages of the present disclosure will become apparent and more readily appreciated from the following description of several embodiments, taken in conjunction with the accompanying drawings, in which.

DETAILED DESCRIPTION OF SEVERAL EMBODIMENTS

Figure 1:
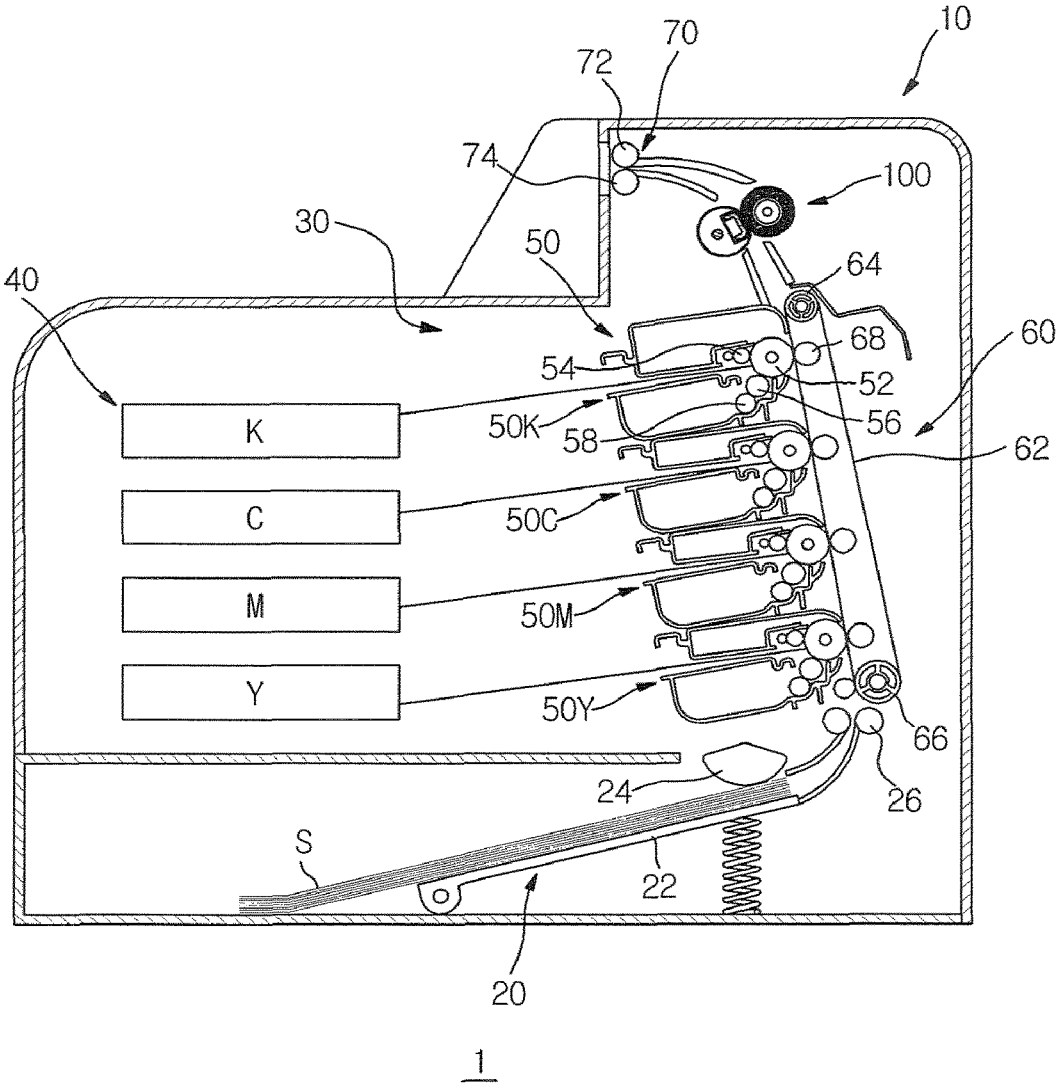
FIG. 1 is a view illustrating the configuration of an image forming apparatus according to an embodiment.

Reference will now be made in detail to several embodiments, examples of which are illustrated in the accompanying drawings, wherein like reference numerals refer to like elements throughout. The embodiments are described below as examples to facilitate a thorough understanding of various aspects of the present disclosure.

FIG. 1 is a view illustrating an example of the configuration of an image forming apparatus according to an embodiment.

As shown in FIG. 1, the image forming apparatus 1 includes a body 10, a printing medium supply device 20, a printing device 30, a fusing device 100 and a printing medium discharge device 70.

The body 10 can define the exterior appearance of the image forming apparatus 1, and can support therein one or more elements of the image forming apparatus 1. The body 10 can include a cover (not shown) configured to open and close a portion of the body 10, and a body frame (not shown) configured to support or fix one or more elements disposed within the body 10.

The printing medium supply device 20 can be configured to supply printing media S to the printing device 30. The printing medium supply device 20 can include a tray 22 in which printing media S can be stored, and a pickup roller 24 configured to pick up the printing media S stored in the tray 22, e.g., one sheet at a time. Delivery rollers 26 can be further provided to deliver the printing medium S to the printing device 30 after the printing medium S is picked up by the pickup roller 24.

The printing device 30 can include a light scanning device 40, a developing device 50 and a transfer device 60. The printing device 30 can be configured to form a toner image based on image information provided by an external device, such as a computer, for example.

The light scanning device 40 can include an optical system (not shown), and can be configured to irradiate light corresponding to image information to the developing device 50. The image information can include color image information, for example, image information associated with four color, e.g., yellow (Y), magenta (M), cyan (C) and black (K).

The image forming apparatus 1 according to an embodiment can be a color image forming apparatus, in which case, the developing device 50 can include four developing units 50Y, 50M, 50C, and 50K in which different colors of toner, for example, yellow (Y), magenta (M), cyan (C) and black (K) toners, can be received, respectively.

Each of the developing units 50Y, 50M, 50C, or 50K can include a photoconductor 52 having a surface on which an electrostatic latent image can be formed by the light scanning device 40, a charging roller 54 configured to charge the photoconductor 52, a developing roller 56 configured to develop the electrostatic latent image formed on the photoconductor 52 into a toner image, and a feeding roller 58 configured to feed toner to the developing roller 56.

The transfer device 60 can be configured to transfer the toner image, formed on the photoconductor 52, to a printing medium S. The transfer device 60 can include a transfer belt 62 configured to circulate in contact with the photoconductors 52, a transfer belt driving roller 64 configured to drive the transfer belt 62, a tension roller 66 configured to maintain a tensile force of the transfer belt 62 and multiple transfer rollers 68 configured to transfer the toner image formed on the photoconductor 52 to the printing medium S.

The printing medium S can be delivered by the transfer belt 62 at substantially the same speed as the traveling speed of the transfer belt 62. According to an embodiment, the toner image on the photoconductor 52 can be transferred to the printing medium S when, for example, a voltage having an opposite polarity to the toner particles on the photoconductor 52 is applied to the respective transfer rollers 68.

The fusing device 100 can be configured to fix or fuse the toner image, which had been transferred to the printing medium S by the transfer device 60, to the printing medium S. A more detailed description of the fusing device 100 will provided below.

The printing medium discharge device 70 can be configured to discharge the printing medium S out of the body 10. The printing medium discharge device 70 can include a discharge roller 72 and a pinch roller 74 opposing the discharge roller 72.

Figure 2:
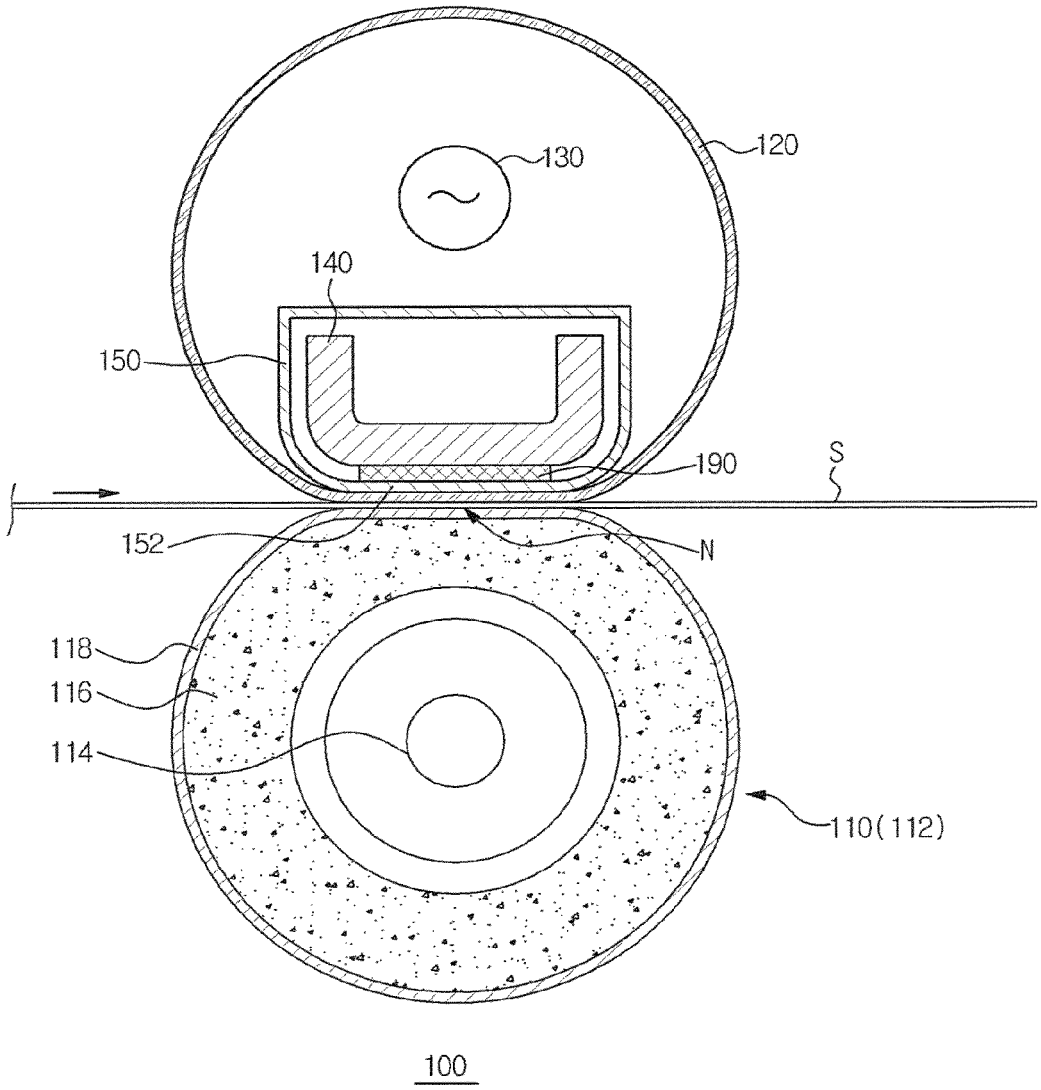
FIGS. 2 to 4 are respectively a sectional view, an assembly perspective view and an exploded perspective view each illustrating the configuration of a fusing device according to an embodiment.
Figure 3:
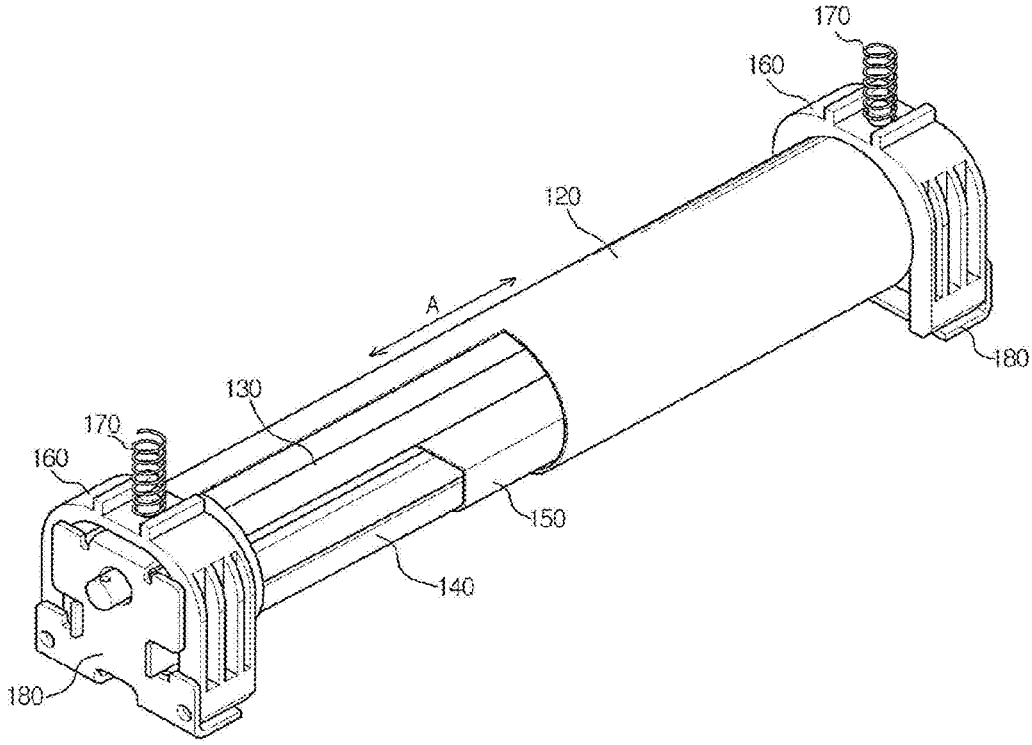
Figure 4:
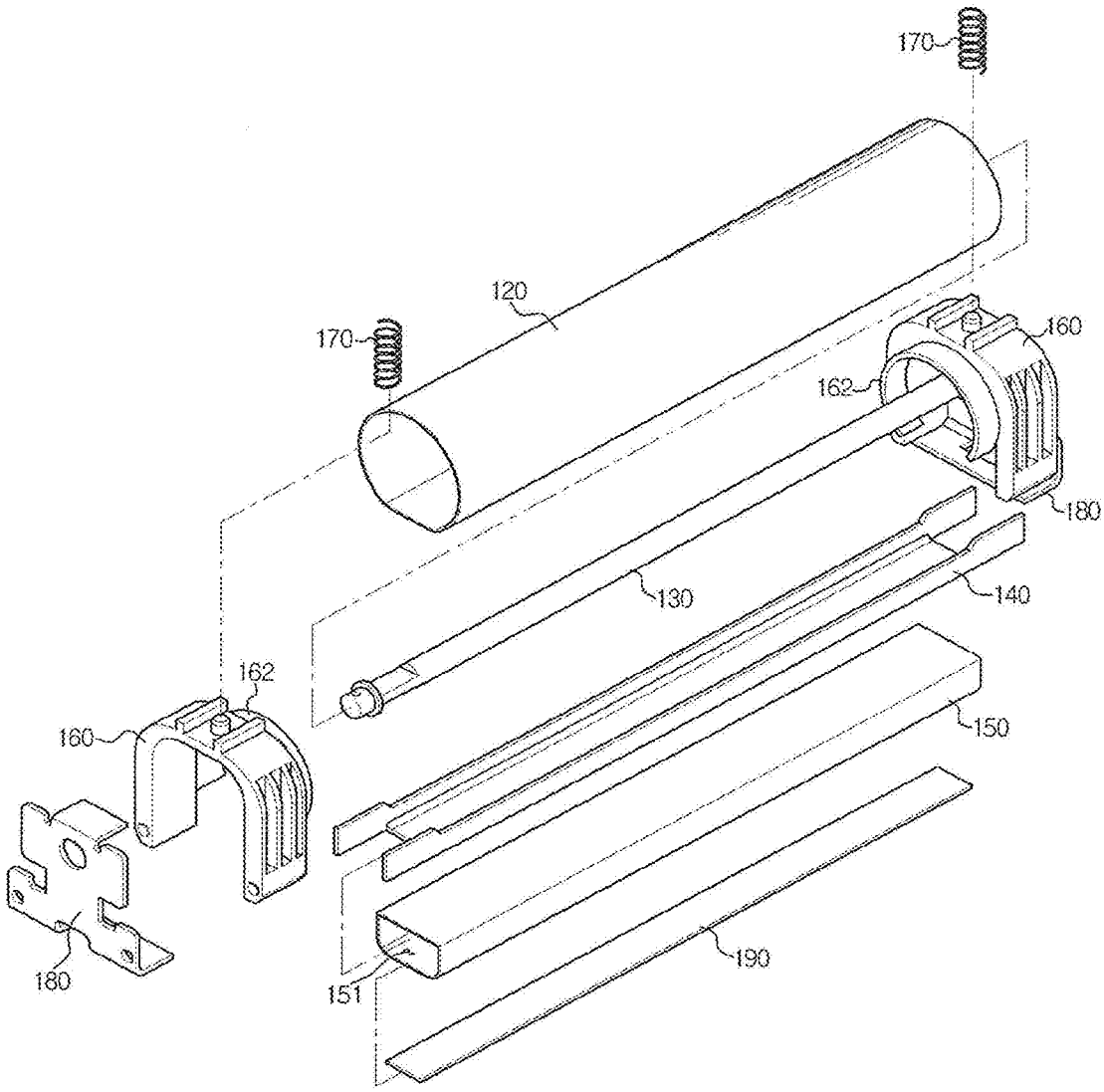

FIGS. 2 to 4 are respectively a sectional view, a perspective view and an exploded perspective view illustrating an example of the configuration of a fusing device according to an embodiment. For brevity, in FIGS. 3 and 4, illustrations of a rotating member 110 is omitted.

As shown in FIGS. 2 to 4, the fusing device 100 can include a rotating member 110, a fusing belt 120, a heater 130, a press member 140 and a heat shield unit 150.

When the printing medium S bearing the transferred toner image passes between the rotating member 110 and the fusing belt 120, the toner image can be fixed to the printing medium S by heat and/or pressure.

The rotating member 110 can be arranged close to an outer periphery of the fusing belt 120, allowing a fusing nip N to be defined between the fusing belt 120 and the rotating member 110. The rotating member 110 can be made of, for example, a fusing roller 112 configured to rotate upon receiving power from a drive source (not shown).

The fusing roller 112 can include a shaft 114 made of a metal, such as aluminum or steel, for example, and an elastic layer 116 adapted or configured to define the fusing nip N with the fusing belt 120 via elastic deformation thereof. The elastic layer 116 can be made of, for example, silicon rubber. A release layer 118 can be provided on an outer surface of the elastic layer 116 to prevent the printing medium S from adhering to the fusing roller 112.

The fusing belt 120 can be rotated while in contact with the fusing roller 112. The fusing belt 120 can define the fusing nip N in conjunction with the fusing roller 112. The fusing belt 120 can be heated by the heater 130 to transmit heat to the printing medium S passing through the fusing nip N. The fusing belt 120 can be made of a single metal layer, a heat-resistant polymer and/or other like material, and can further include an elastic layer and/or a protective layer in addition to the metal layer or the heat-resistant polymer. An inner surface of the fusing belt 120 can be covered with a dark colored (e.g., black) material and/or can be coated with other material that promotes heat absorption.

The heater 130 can be configured to allow direct radiative heating of at least a portion of an inner periphery of the fusing belt 120. The heater 130 can be implemented by using a halogen lamp, for example, or by using various other devices such as an electrical wire, a sheet-type heating element and/or other like devices.

Supporting members 160 (see FIG. 3) can be disposed at opposite ends of the fusing belt 120. The supporting members 160 can be configured to support elements of the fusing device 100. The fusing belt 120 can be rotatably supported by the supporting members 160. The supporting members 160 can respectively include belt supporting portions 162 (see FIG. 4) that protrude toward the fusing belt 120 to support the ends of the fusing belt 120.

Each of the supporting members 160 can be pressed toward the rotating member 110 by an elastic member 170. One end of the elastic member 170 can be supported by the top of the supporting member 160 while the other end of the elastic member 170 can be supported by a separate frame (not shown), for example.

A holder 180 can be coupled to the supporting member 160. The holder 180 can be located outside of the supporting member 160, and can be configured to support an end of the heater 130 and an end of the press member 140. A press force acting on the supporting member 160 can in turn be applied to the press member 140 via the holder 180 to cause the press member 140 to be pressed or pushed toward the rotating member 110.

The press member 140 can be configured to apply a pressure to the inner periphery of the fusing belt 120 to define the fusing nip N between the fusing belt 120 and the rotating member 110. The press member 140 can be made of a high-strength material, such as, for example, stainless steel, carbon steel and/or other like material. When the press member 140 is made of a low-strength material, the press member can bend and, as a result, may not be able to provide uniform pressure at the fusing nip N. Thus, the press member 140 can be made to have a cross section that is suitable to provide a large inertial moment, such as an arch-shaped cross section, an inverted arch-shaped cross section, an I-beam-shaped cross section, or an H-beam-shaped cross section, for example, to reduce bending of the press member 140.

When the press member 140 is directly heated by radiative heat from the heater 130, the press member 140 can deform because of an excessive increase in temperature, and, as a result, may not be able to provide uniform pressure at the fusing nip N. Moreover, when a substantial portion of the heat produced by the heater 130 is used to heat the press member 140, the temperature increase performance of the fusing device 100 can deteriorate.

The heat shield unit 150 can be disposed between the heater 130 and the press member 140 to absorb heat that is directly radiated to the press member 140 to reduce the likelihood of heat related deformation of the press member 140.

The heat shield unit 150 can surround the press member 140. Such an embodiment can effectively shield not only the radiative heat reflected from the surface of the fusing belt 120, but also secondary radiative heat emitted by the fusing belt 120 when the fusing belt 120 has been heated by the heater 130. The heat shield unit 150 can be made of a single member having a sufficient interior space for receiving the press member 140.

The heat shield unit 150 can have openings 151 (see FIG. 4) formed at opposite ends thereof. Opposite ends of the press member 140 can extend out of the heat shield unit 150 through the openings 151 of the heat shield unit 150. Each end of the press member 140 can be coupled to one of the holders 180, and can be configured to receive a press force applied by the elastic member 170.

The heat shield unit 150 can include a heat conducting portion 152, which comes into contact with the inner periphery of the fusing belt 120 and is configured to conduct heat to the fusing nip N. Such an embodiment can prevent overheating of the heat shield unit 150, and can allow for a more rapid heating of the fusing belt 120.

The heat shield unit 150 can be made of a material having a high heat conductivity. In some embodiments, the heat shield unit 150 can be made of a material having heat conductivity that is higher than the heat conductivity of the press member 140. The heat shield unit 150 can be made of aluminum, copper and/or alloys thereof, for example.

When the length of the heat shield unit 150 along the direction A (see FIG. 3) is shorter than the length of the fusing belt 120, it is possible for the inner periphery of the fusing belt 120 to be scratched and/or damaged by the ends of the heat shield unit 150. According to an embodiment, the heat shield unit 150 can thus advantageously be made longer than the fusing belt 120 along the direction A.

A spacer 190 can be disposed between the heat shield unit 150 and the press member 140 (see FIG. 2). The spacer 190 can be configured to provide a space that separates the heat shield unit 150 and the press member 140 from each other to prevent heat from the heat shield unit 150 being transferred to the press member 140. The spacer 190 can be made of a heat-resistant material having a low heat conductivity. Moreover, the spacer 190 can be made of a material having a heat conductivity that is lower than the heat conductivity of the heat shield unit 150. For example, the spacer 190 can be made of heat-resistant resins (e.g., PolyEther Ether Ketones (PEEK), Liquid Crystal Polymer (LCP)) or from other materials, such as ceramics, for example.

Hereinafter, an operation of the fusing device according to an embodiment is described with reference to FIGS. 1 and 2.

A portion of the fusing belt 120, which is directly exposed to the heater 130, can be subjected to radiative heating from the heat generated by the heater 130. Although a portion of the heat generated by the heater 130 can be transferred to the press member 140, the heat shield unit 150 disposed around the press member 140 can absorb or intercept the heat that is directly radiated to the press member 140, allowing the press member 140 to be kept at a relatively low temperature. As a result, the press member 140 can be substantially free from heat induced deformation, and can contribute to a uniform fusing nip N.

The heat shield unit 150 can come into contact with the inner periphery of the fusing belt 120 near the fusing nip N, and can transfer heat to the fusing belt 120. Because the heat shield unit 150 can be made of a material having a high heat conductivity, a rapid heat transfer from the heat shield unit 150 to the fusing belt 120 can be accomplished, which helps to produces a rapid increase in the temperature of the fusing belt 120.

Once the fusing belt 120 is heated to an appropriate temperature, a printing operation can begin in response to a user print command. An electrostatic latent image, corresponding to image information, can be formed on a surface of the photoconductor 52 by the light scanning device 40. The developing device 50 can feed toner to the electrostatic latent image on the surface of the photoconductor 52 to form a visible toner image. The transfer device 60 can transfer the toner image on the photoconductor 52 to a printing medium S supplied via the printing medium supply device 20. As the printing medium S, to which the toner image has been transferred, passes between the rotating member 110 and the fusing belt 120 in the fusing device 100, the toner image can be fixed to the printing medium S by the heat transferred from the fusing belt 120 and by pressure applied between the rotating member 110 and the fusing belt 120.

Figure 5:
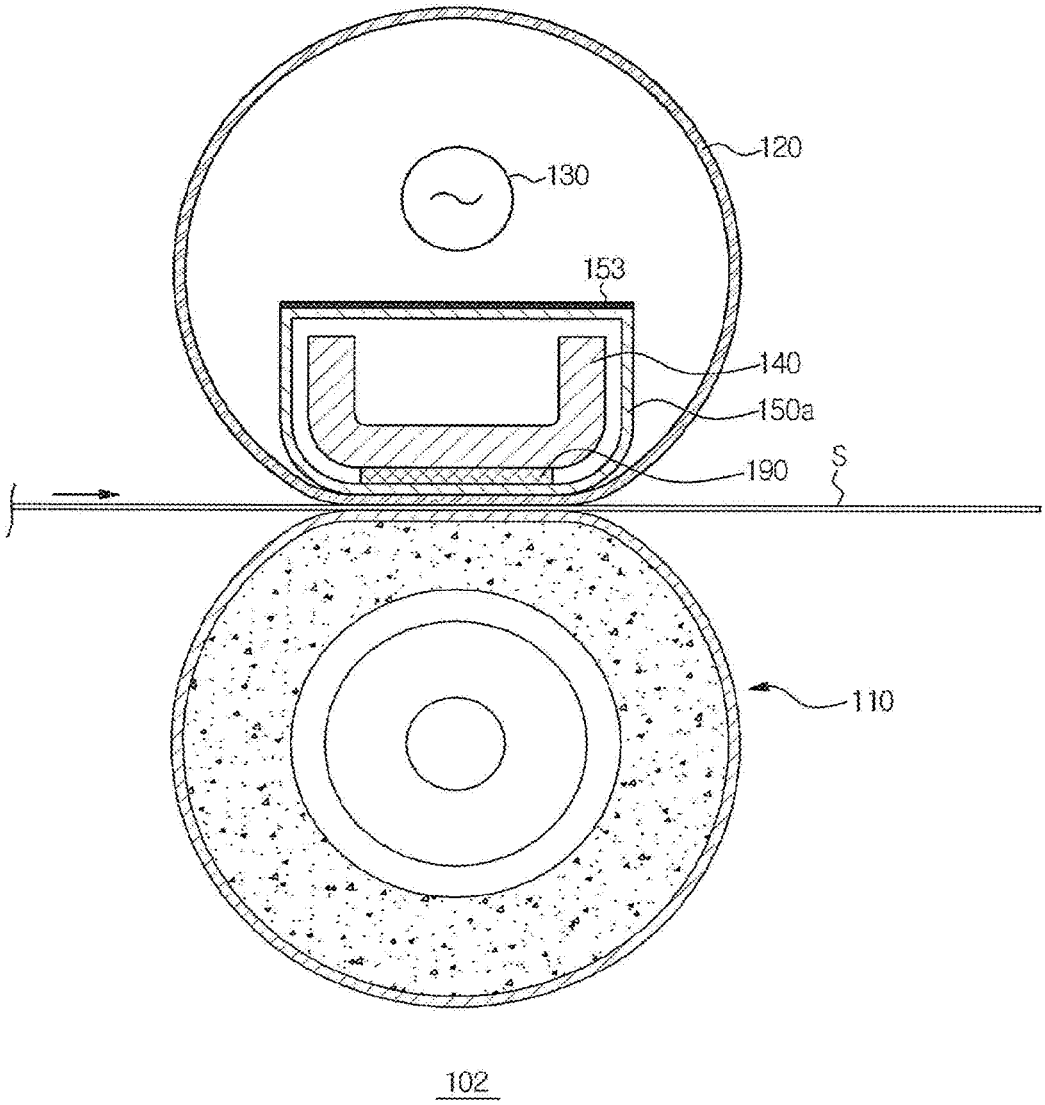
FIG. 5 is a sectional view illustrating the configuration of a fusing device according to another embodiment.

FIG. 5 is a sectional view illustrating the configuration of a fusing device according to another embodiment. As shown in FIG. 5, a fusing device 102 can include the rotating member 110, the fusing belt 120, the heater 130, the press member 140, a heat shield unit 150*a* and the spacer 190. For brevity sake, those elements that are substantially the same as those elements previously described above in reference to FIGS. 2 through 4 are assigned the same reference numerals, and the detailed descriptions thereof will not be repeated.

The heat shield unit 150*a* can include a reflecting layer 153 configured to reflect heat from the heater 130. The reflecting layer 153 can be disposed on a surface of the heat shield unit 150*a* that opposingly faces the heater 130. To form the reflecting layer 153, a reflective material, such as silver, for example, can be coated over the heat shield unit 150*a*.

When the heat shield unit 150*a* is provided with the reflecting layer 153, heat radiated to the heat shield unit 150*a* can be reflected toward the fusing belt 120 to facilitate heating of the fusing belt 120.

Figure 6:
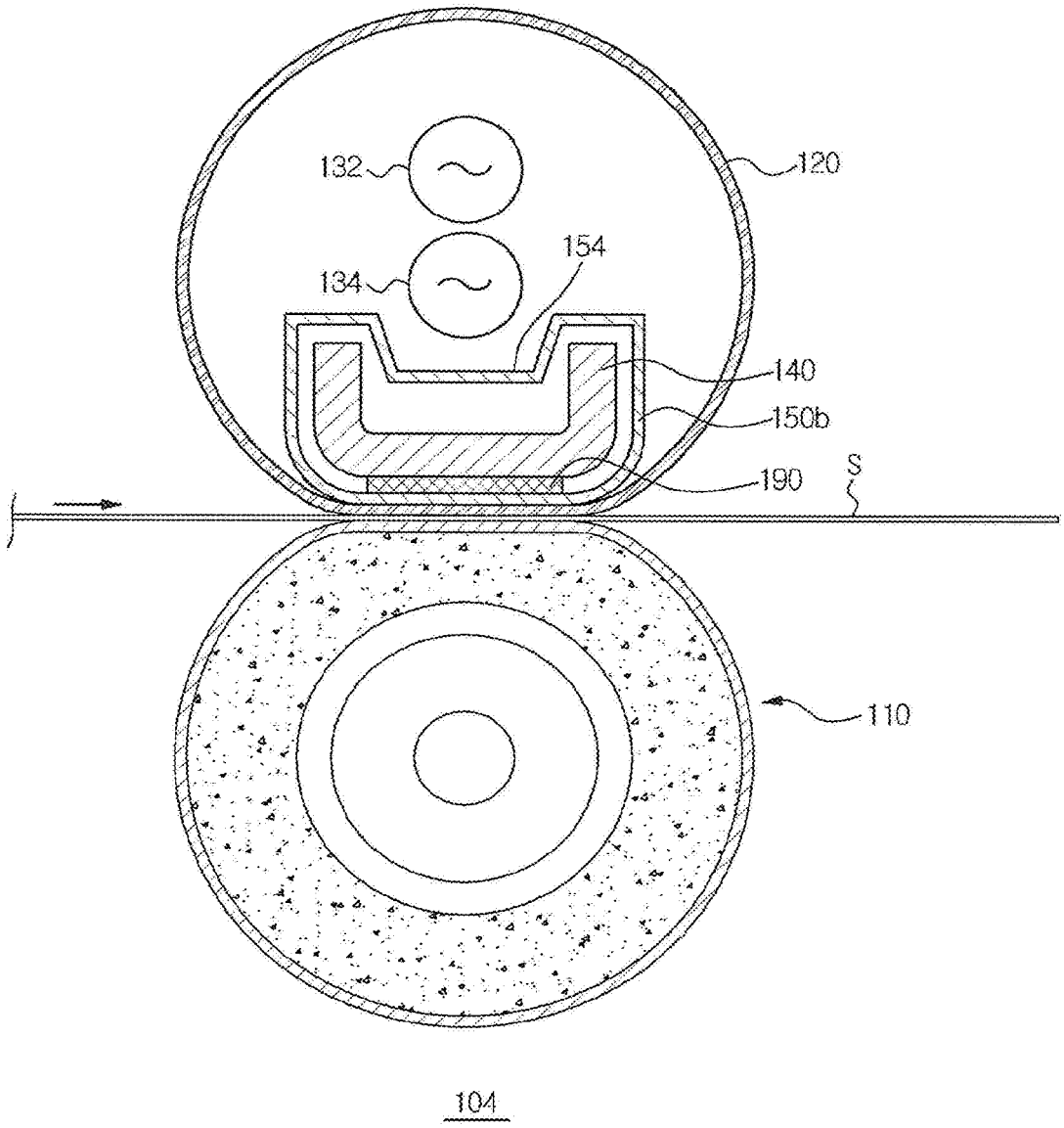
FIG. 6 is a sectional view illustrating the configuration of a fusing device according to another embodiment.

FIG. 6 is a sectional view illustrating the configuration of a fusing device according to a another embodiment. Again, those elements shown in FIG. 6 that are substantially the same as those elements previously described above in reference to FIGS. 2 through 4 are assigned the same reference numerals, and the detailed descriptions thereof will not be repeated. As shown in FIG. 6, a heat shield unit 150*b* of a fusing device 104 can have a cavity 154 indented or recessed toward the press member 140. According to an embodiment, the press member 140 can have an inverted arch shape and the cavity 154 can have a shape that is complementary to the shape of the press member 140.

When a high speed printing operation or when a large width printing medium is desirable, two or more heaters 132 and 134 can be disposed inside the fusing belt 120 to obtain a required heat capacity. In such configuration, although it may be difficult to install or dispose two or more heaters inside the fusing belt 120 because of the confined space, using the heat shield unit 150*b* with the cavity 154 can allow for effective space utilization that allows the space for installation of multiple heaters.

Figure 7:
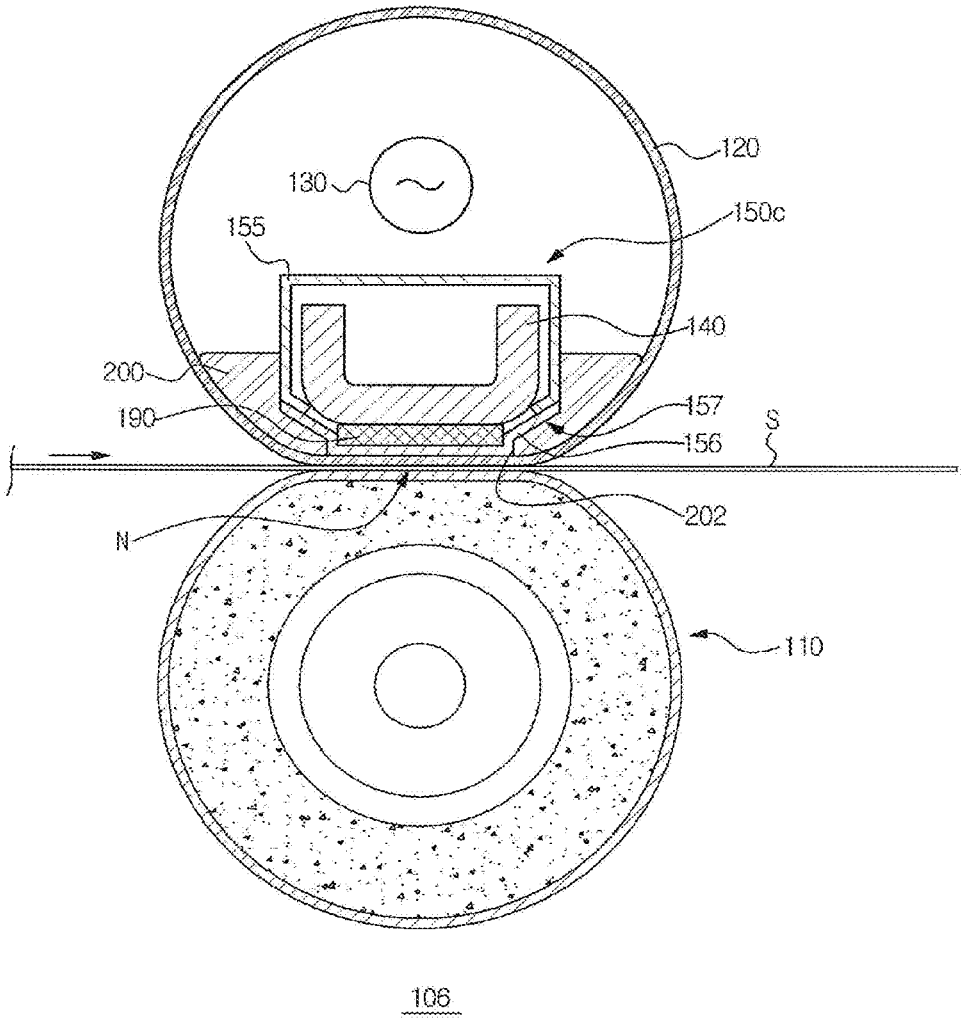
FIG. 7 is a sectional view illustrating the configuration of a fusing device according to another embodiment.

FIG. 7 is a sectional view illustrating a configuration of a fusing device according to a another embodiment. In FIG. 7, elements in common with FIG. 2 are designated by the same reference numerals, and the detailed descriptions thereof will not be repeated.

As shown in FIG. 7, a fusing device 106 can includes the rotating member 110, fusing belt 120, the heater 130, the press member 140, a heat shield unit 150*c*, the spacer 190 and the guide member 200.

The heat shield unit 150*c* can include a first heat shield member 155, at least a portion of which is configured to opposingly face the heater 130, and a second heat shield member 156, at least a portion of which is configured to opposingly face the inner periphery of the fusing belt 120. When the heat shield unit 150*c* includes multiple separable members, changing, for example, the shape and/or material of portions of the heat shield unit 150*c* can be possible when appropriate, and processing of the heat shield unit 150*c* can be simplified.

In some embodiments, the first heat shield member 155 and second heat shield member 156 can be made of different materials. For example, the first heat shield member 155 can be disposed close to the heater 130 and can be made of a material having a heat conductivity higher than a heat conductivity of the second heat shield member 156, whereas the second heat shield member 156 can be in contact with the fusing belt 120 and can be made of a material having a strength higher than a strength of the first heat shield member 155. In such an embodiment, the heat conductivity of the heat shield unit 150*c* can be enhanced while the strength of the heat shield unit 150*c* can be reinforced to prevent the second heat shield member 156 from being deformed by heat and pressure.

Although the first heat shield member 155 and second heat shield member 156 can be coupled to each other by welding or riveting, for example, coupling of the first and second heat shield members 155 and 156 can be implemented through other coupling mechanisms and methods, for example, by providing interlocking shapes of the two members.

The heat shield unit 150*c* can include an overlap portion 157 where the first heat shield member 155 and second heat shield member 156 overlap each other. The overlap portion 157 can be configured to more effectively intercept or absorb heat radiated toward the press member 140.

When the fusing belt 120 cannot smoothly enter the fusing nip N, wrinkles can be produced on the fusing belt 120 or the fusing belt 120 can be damaged by an excessive amount of stress acting thereon. To prevent such an occurrence, the fusing device 106 can include the guide member 200 to support and guide the inner periphery of the fusing belt 120 near the fusing nip N.

The guide member 200 can be disposed between the fusing belt 120 and the heat shield unit 150*c*. The guide member 200 can be centrally formed with an opening 202 that allows the second heat shield member 156 to come into contact with the inner periphery of the fusing belt 120.

An outer surface of the guide member 200 near the fusing nip N can support the inner periphery of the fusing belt 120 and an inner surface of the guide member 200 can support outer surfaces of the first heat shield member 155 and the second heat shield member 156 to prevent movement of the heat shield unit 150*c*.

To prevent the guide member 200 in contact with the fusing belt 120 from lowering the temperature of the fusing belt 120 and to reduce the transfer of radiative heat from the fusing belt 120 to the press member 140, the guide member 200 can be made of a heat-resistant material having a low heat conductivity. For example, the guide member 200 can be made of heat-resistant resins (e.g., PolyEther Ether Ketones (PEEK), Liquid Crystal Polymer (LCP)) and/or other materials, such as ceramics, for example.

With the fusing device and image forming apparatus according to one or more aspects illustrated in reference to one or more embodiments described above, when heat generated from the heater is transmitted to the fusing belt to heat the fusing nip, effective transfer of energy can be accomplished. Such an effective transfer can enhance the temperature increase performance and reduce the time to output a first page. Moreover, the time required to go from a standby mode to a print mode can be reduced, contributing to a further energy reduction.

Furthermore, according one or more aspects illustrated in reference to one or more embodiments described above, the heat shield unit can restrict or limit the temperature increase of the press member, thereby reducing material degradation during a prolonged use of the fusing device in a high temperature environment, and realizing improved durability and reliability of the fusing device.

The heat shield unit according to one or more embodiments can restrict local temperature increase at the surface of the press member near the heater, and can reduce heat deformation of the press member. As a result, a uniform fusing nip and a stable fusing performance can be maintained.

Moreover, according to one or more embodiments, because the heating function with relation to the fusing belt and the pressing function for formation of a fusing nip are independent of each other, preventing damage to elements because of the combined effects of heat and pressure is possible.

According to one or more embodiments afore-described, a fusing device can be provided to realize improved temperature increase performance and fusing performance characteristics while also reducing the likelihood of heat and/or pressure induced damages to one or more components thereof.

Although several embodiments have been shown and described, it would be appreciated by those skilled in the art that changes may be made in these embodiments without departing from the principles and spirit of the disclosure, the scope of which is defined in the claims and their equivalents.

What is claimed is:

1. A fusing device, comprising:

a heater configured to generate heat;

a fusing belt disposed around the heater;

a rotating member configured to rotate in contact with an outer periphery of the fusing belt;

a press member disposed within the fusing belt, the press member being configured to press a portion of the fusing belt toward the rotating member to define a fusing nip between the fusing belt and the rotating member; and a heat shield unit configured to surround the press member to reduce an amount of heat received by the press member from the heater.

2. The fusing device according to claim 1, wherein the heat shield unit includes a heat conducting portion configured to come into contact with an inner periphery of the fusing belt, the heat conducting portion being configured to conduct heat to the fusing nip.

3. The fusing device according to claim 1, wherein the heat shield unit has a heat conductivity higher than that of the press member.

4. The fusing device according to claim 2, further comprising:

a spacer disposed between the heat conducting portion of the heat shield unit and the press member.

5. The fusing device according to claim 4, wherein the spacer has a heat conductivity lower than a heat conductivity of the heat shield unit.

6. The fusing device according to claim 1, wherein the heat shield unit has an inverted arch shape.

7. The fusing device according to claim 1, wherein the heat shield unit includes a layer configured to reflect heat generated by the heater, the layer being disposed in a portion of the heat shield unit facing the heater.

8. The fusing device according to claim 1, wherein a portion of the heat shield unit defines an indentation directed toward the press member.

9. The fusing device according to claim 1, wherein an opening is defined at each end of the heat shield unit, the press member being configured to have opposite ends that protrude out of the openings at the ends of the heat shield unit.

10. The fusing device according to claim 1, wherein the heat shield unit is longer than the fusing belt.

11. The fusing device according to claim 1, wherein the heat shield unit is formed as a single unitary member.

12. The fusing device according to claim 1, wherein the heat shield unit includes a first heat shield member and a second heat shield member, at least a portion of the first heat shield member being configured to face the heater, at least a portion of the second heat shield member being configured to face the inner periphery of the fusing belt.

13. The fusing device according to claim 12, wherein the first heat shield member is made of a first material, the second heat shield member being made of a second material different from the first material.

14. The fusing device according to claim 12, wherein the heat shield unit includes an overlap portion where the first heat shield member and the second heat shield member overlap each other.

15. The fusing device according to claim 1, further comprising:

a guide member disposed between the heat shield unit and the fusing belt, the guide member being configured to support the heat shield unit and to guide the fusing belt near the fusing nip.

16. An image forming apparatus, comprising:

a printing device configured to form an image on a printing medium; and a fusing device configured to fix the image to the printing medium, wherein the fusing device includes:

a heater configured to generate heat;

a fusing belt disposed around the heater;

a rotating member configured to rotate in contact with an outer periphery of the fusing belt;

a press member configured to press a portion of the fusing belt toward the rotating member to define a fusing nip between the fusing belt and the rotating member; and a heat shield unit including a first portion and a second portion, the first portion of the heat shield unit being located between the heater and the press member and being configured to absorb heat radiating from the heater, the second portion being configured to come into contact with an inner periphery of the fusing belt to thereby conduct heat to the fusing nip.

17. The image forming apparatus according to claim 16, wherein the press member is disposed inside the heat shield unit.

18. The image forming apparatus according to claim 16, wherein the heat shield unit has a heat conductivity higher than a heat conductivity of the press member.

19. The image forming apparatus according to claim 16, wherein the fusing device further includes a spacer disposed between the second portion of the heat shield unit and the press member.

20. The image forming apparatus according to claim 16, wherein the heat shield unit includes a layer disposed over the first portion of the heat shield unit, the layer being configured to reflect heat from the heater.

21. The image forming apparatus according to claim 16, wherein the heat shield unit defines an indentation in the first portion of the heat shield unit.

22. The image forming apparatus according to claim 16, wherein the heat shield unit includes a plurality of members, a first one of which member being made of a first material different from a second material of which a second one of the plurality of members is made.

23. A fusing device for fixing a toner image on a print medium, comprising:

a belt defining a loop;

a heat source disposed inside the loop, the heat source being configured to produce heat;

a first member disposed inside the loop, the first member being configured to exert a pressure on a first portion of inner periphery of the belt; and a second member configured to shield the first member from the heat produced by the heat source, a portion of the second member being in contact with the first portion of inner periphery of the belt.

24. The fusing device of claim 23, further comprising:

a third member disposed outside the loop, the third member being configured to rotate in contact with an outer periphery of the belt to define a fusing nip at a nip portion between the belt and the third member and in proximity to the first portion of inner periphery of the belt.

25. The fusing device of claim 23, wherein the second member defines an indentation, wherein the heat source comprises a plurality of heat sources, at least one of the plurality of heat sources at least partially occupying a space defined by the indentation in the second member.

* * * * *